US011684837B2

(12) United States Patent
Reeves

(10) Patent No.: US 11,684,837 B2
(45) Date of Patent: Jun. 27, 2023

(54) COLLAPSIBLE FIELD GAME GOAL

(71) Applicant: Francis J Reeves, Severn, MD (US)

(72) Inventor: Francis J Reeves, Severn, MD (US)

(73) Assignee: First Goal, LLC

( * ) Notice: Subject to any disclaimer, the term of this patent is extended or adjusted under 35 U.S.C. 154(b) by 5 days.

(21) Appl. No.: 17/372,348

(22) Filed: Jul. 9, 2021

(65) Prior Publication Data

US 2023/0012057 A1 Jan. 12, 2023

(51) Int. Cl.
*A63B 63/00* (2006.01)

(52) U.S. Cl.
CPC ..... *A63B 63/004* (2013.01); *A63B 2210/52* (2013.01)

(58) Field of Classification Search
CPC ..... A63B 63/004
See application file for complete search history.

(56) References Cited

U.S. PATENT DOCUMENTS

| | | | | |
|---|---|---|---|---|
| 5,566,952 | A * | 10/1996 | Mullin | A63B 63/004 273/400 |
| 5,681,231 | A | 10/1997 | Reeves | |
| 5,954,600 | A * | 9/1999 | Gill | A63B 63/004 273/400 |
| 6,220,776 | B1 | 4/2001 | Reeves | |
| 6,561,931 | B1 | 5/2003 | Reeves | |
| 7,377,714 | B2 | 5/2008 | Reeves | |
| 8,657,521 | B2 | 2/2014 | Reeves | |
| 8,663,037 | B2 | 3/2014 | Reeves | |
| 2013/0157790 | A1 * | 6/2013 | Nalepa | A63B 63/004 473/478 |

* cited by examiner

*Primary Examiner* — Laura Davison
(74) *Attorney, Agent, or Firm* — David R. Wood

(57) ABSTRACT

A game goal includes a net and a support frame by which the net is supported. The support frame is articulated to collapse into a storage-ready state and expand into a play-ready state. The support frame is further selectively retained in the game-ready state by a snap fit on each of opposing sides thereof.

14 Claims, 21 Drawing Sheets

COLLAPSIBLE FIELD GAME GOAL

TECHNICAL FIELD

The present disclosure relates to goals for field games, such as soccer, field hockey and lacrosse. More specifically, the concepts described herein are directed to such goals that are mechanically collapsible or foldable from a fully-opened ready-for-play configuration to a fully-collapsed ready-for-transport/stowage configuration.

BACKGROUND

Field game goals, as used herein, are mechanical structures that define a plane, referred to herein as a goal plane, which must be broken by a projectile (e.g., a ball or a puck) in order to advance a game score of the entity (e.g., an individual or a team) that caused the projectile to break the goal plane in the particular game being played. As used herein, the word "field," such as in "field of play" or "field game," refers to a typically open area having a surface suitable for the particular game being played. Such surface may include, among other things, grass, wood, asphalt, clay, ASTROTURF or other imitation grass product, ice and concrete. Those acquainted with sports or field games will appreciate and recognize the variants of both indoor and outdoor spaces that fit the definition above.

Game goals vary in configuration, typically in accordance with the game being played (e.g., soccer, hockey, etc.) and by the size and capabilities of the players (e.g., youth game goals are typically smaller than their full-sized adult counterparts).

Certain fields of play have dedicated game goals that are permanently installed at the field. The game goals at such permanent installations are generally fixed in their configuration, often being constructed from metal frame members or from glued plastic frame members into stable and sturdy structure that is not intended to be moved, at least easily. However, other fields are intended for general game play and do not have permanently installed game goals. Thus, at such fields of play, temporarily installed game goals are required to play the corresponding field games. To that end, portable game goals have been developed that can be transported to and from a field for game play.

Many portable game goals are collapsible whereby they define a smaller footprint/volume for transport and storage. Although such collapsible game goals provide advantages, e.g., ability to establish a play area in a suitably open space, ability to conveniently store the game goal in a condensed state, etc., collapsible game goals can be less rugged that their non-collapsible counterparts. Research and development activities geared towards designing more sturdy collapsible game goals are ongoing.

SUMMARY

A game goal includes a net and a support frame by which the net is supported. The support frame is articulated to collapse into a storage-ready state and expand into a play-ready state. The support frame is further selectively retained in the play-ready state by a snap fit on each of opposing sides thereof.

In other aspects, a support frame of a game goal supports a net disposed thereon. The support frame includes rigid frame members including uprights and a crossbar by which a goal plane is defined. Mechanical joints are interposed between and interconnecting the rigid frame members by which the rigid frame members are displaceable one relative to another to collapse the support frame into a storage-ready configuration and to expand the support frame into a play-ready configuration. Corner brackets are mechanically coupled to the crossbar and the respective uprights and each comprise tabs with which the corresponding uprights are captured in a snap fit.

DESCRIPTION OF EXAMPLE EMBODIMENTS

Figure 1:
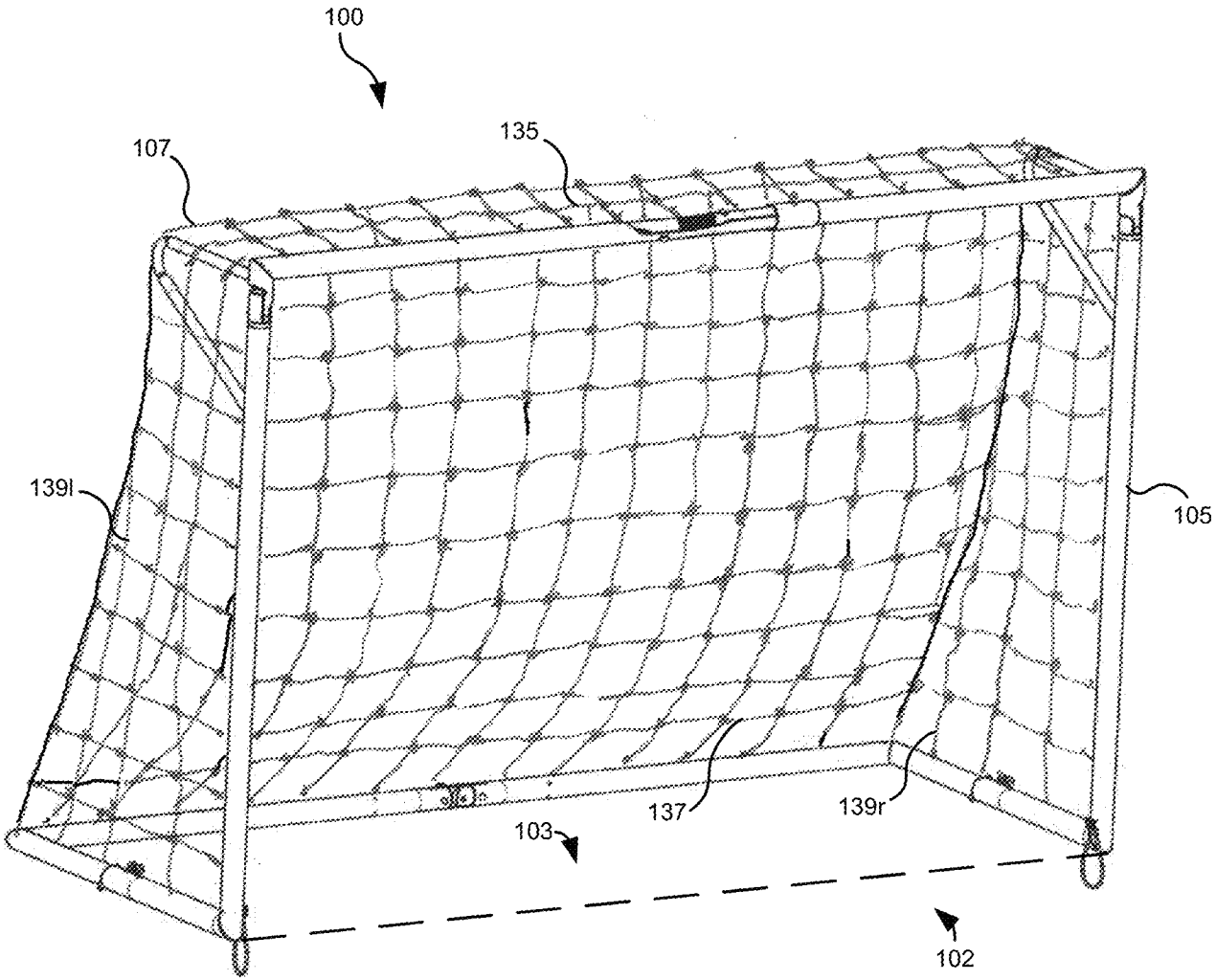
FIG. 1 is an illustration of a soccer goal by which the present inventive concept may be embodied.

The present inventive concept is best described through certain embodiments thereof, which are described in detail herein with reference to the accompanying drawings, wherein like reference numerals refer to like features throughout. It is to be understood that the term invention, when used herein, is intended to connote the inventive concept underlying the embodiments described below and not merely the embodiments themselves. It is to be understood further that the general inventive concept is not limited to the illustrative embodiments described below and the following descriptions should be read in such light.

Additionally, the word exemplary is used herein to mean, "serving as an example, instance or illustration." Any embodiment of construction, process, design, technique, etc., designated herein as exemplary is not necessarily to be construed as preferred or advantageous over other such embodiments.

The inventive concept described herein is directed to game goals, such as those used in the sports of soccer, field hockey, lacrosse, etc. Upon review of this disclosure and appreciation of the concepts disclosed herein, the ordinarily skilled artisan will recognize other structural contexts in which the present inventive concept can be applied. The scope of the present invention is intended to encompass all such alternative implementations.

FIG. 1 is an illustration of a soccer goal 100 in which the present invention may be embodied. As is illustrated, exemplary soccer goal 100 may comprise a support frame 105 and a net 107. In certain embodiments, net 107 may have a cord, wire or similar mechanism (not illustrated) that may be disposed at the edges thereof. Net 107 may be attached to support frame 105 using conventional fastening hardware, such as screws and/or clamps installed on or about the cord, wire or similar mechanism in a manner known to skilled artisans. However, certain fasteners may impede expansion/collapse functionality of game goal 100 (explained in detail below). Embodiments of the present invention may utilize other mechanisms by which net 107 is attached at particular points on support frame 105 without such impediments.

Generally, support frame 105 may define a goal plane 102 that a game projectile must traverse for a player or team to advance their score. For most field games, goal plane 102 is substantially perpendicular to the field of play. Additionally, for purposes of description and not limitation, a ground plane 103 may be defined as that on which game goal 100 is supported against gravity and is typically substantially perpendicular to goal plane 102.

Support frame 105 may be constructed or otherwise configured to support net 107 in particular formation for game play. As illustrated in FIG. 1, net 107, as supported by support frame 105, may be viewed as comprising a set of panels: a hood 135, a backdrop 137 and a pair of side panels 139*l* and 139*r*. When implemented in accordance with this disclosure, support frame 105 may be folded into a compact form for transportation and storage without interference from or undue wear on net 107.

Support frame 105 may be articulated and, as such, may comprise several components, which may be manufactured from lengths of a suitable material such as, for example, metal or plastic. In certain embodiments, the components of support frame 105 are manufactured from lengths of pipe, each such component having thus a hollow interior. In one particular yet nonlimiting example, support frame 105 may be constructed from metal pipe, such as steel pipe. However, as those skilled in the art will appreciate, the present invention is not limited to specific materials for manufacturing individual components of support frame 105.

Figure 2:
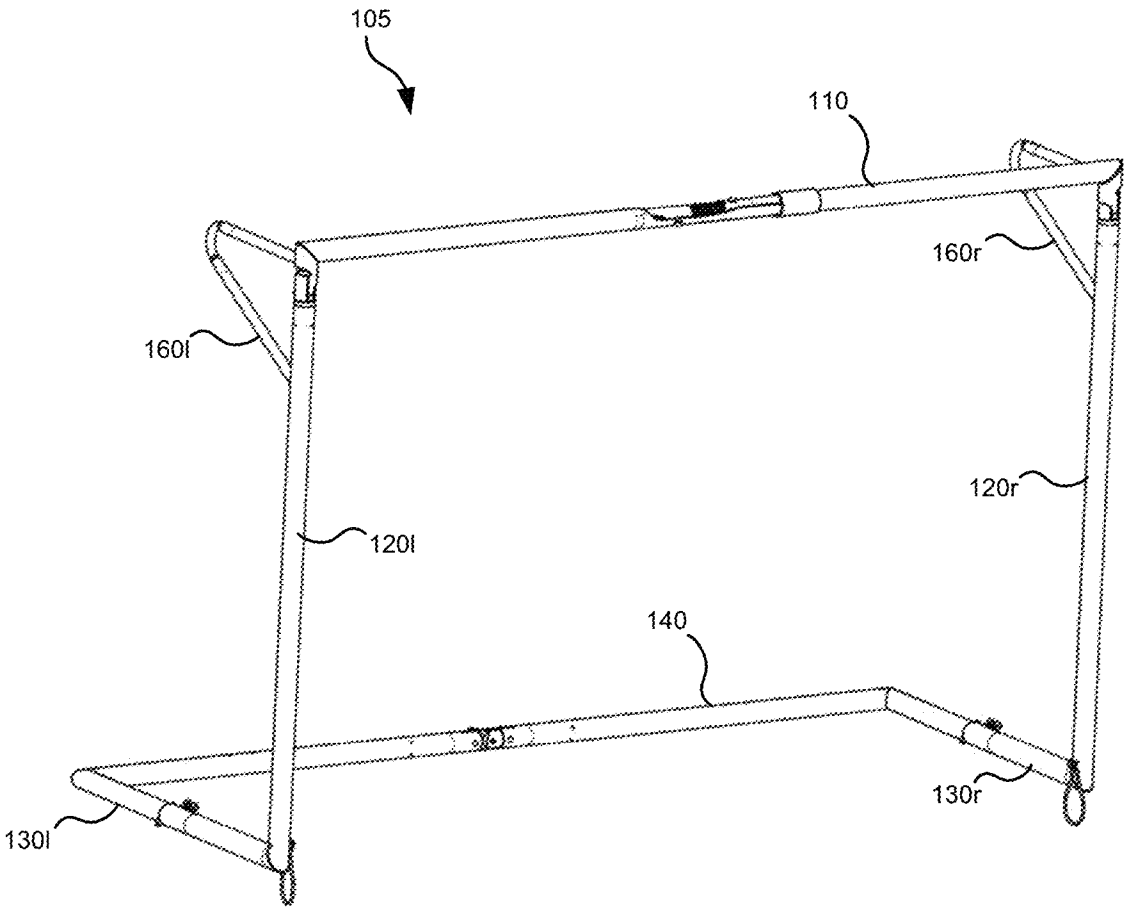
FIG. 2 is an illustration of the soccer goal of FIG. 1 with a goal net removed revealing a support frame by which the present inventive concept may be embodied.

FIG. 2 is an illustration of exemplary soccer goal 100 with net 107 removed for clarity. As illustrated in the figure, exemplary support frame 105 may comprise a pair of uprights 1201 and 120*r* supporting an upper crossbar 110, a pair of base members 130*l* and 130*r* and a lower crossbar 140 coupled to base members 130*l* and 130*r*. As explained below, each of these primary members of support frame 105 may include and/or may be interconnected by mechanisms by which soccer goal 100 can be actuated between a fully-opened state, in which soccer goal 100 is ready for game play, and a fully-collapsed state, in which soccer goal 100 is ready for transport and/or storage.

Support frame 105 may further comprise a pair of backstays 160*l* and 160*r* that are constructed or otherwise configured to support hood 137 of net 105. Backstays 160*l* and 160*r* may be further constructed to include mechanisms by which backstays 160*l* and 160*r* elastically contort to accommodate the folding and unfolding of support frame 105. An example of such contortion is described further below.

Prior to description of exemplary embodiments in finer detail, it is to be first understood that the various operations and/or manipulations and the mechanical responses thereto in game goal 100 described below, unless explicitly stated otherwise, refer to those following a folding procedure in which game goal 100 is collapsed from its fully-opened play-ready state into a fully-collapsed transport/storage-ready state. Complementary unfolding operations for game goal 100 from its transport/storage-ready state into its play-ready state may be accomplished by operations similar to those performed when folding game goal 100, only in reverse. Those having skill in the mechanical arts will recognize and appreciate how unfolding game goal 100 proceeds through such similar operations without details of specific unfolding operations being explicitly set forth herein. Thus, in the following descriptions, folding operations will be explained and the corresponding unfolding operations are to be understood by skilled artisans from the folding operations. However, certain unfolding operations may nevertheless be presented where specific differences exist between folding and unfolding game goal 100 and where the inventive concept being explained would be better understood by such description.

Figure 3A:
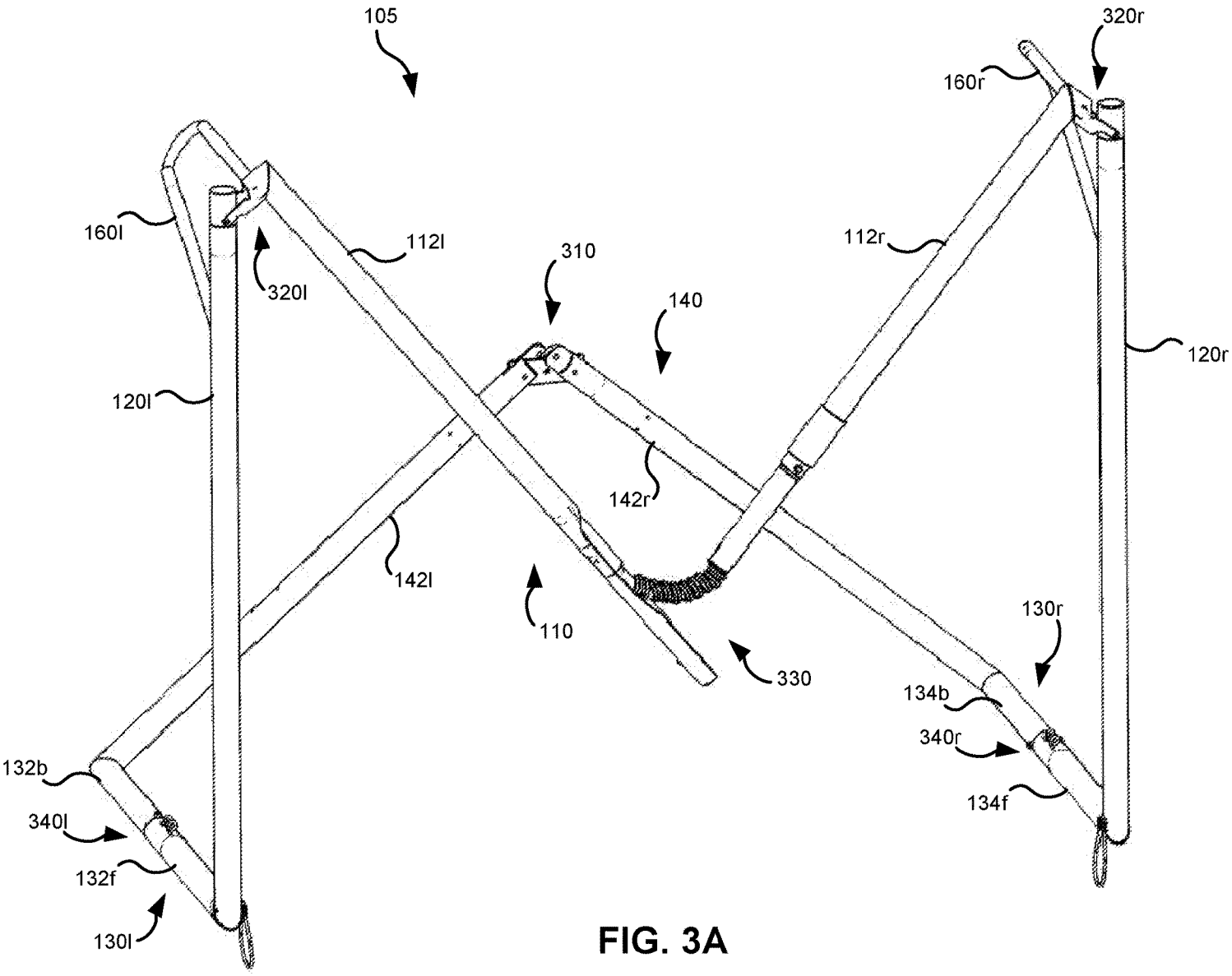
FIGS. 3A and 3B, collectively referred to herein as FIG. 3, is an illustration of the support frame illustrated in FIG. 2 in a semi-collapsed state.
Figure 3B:
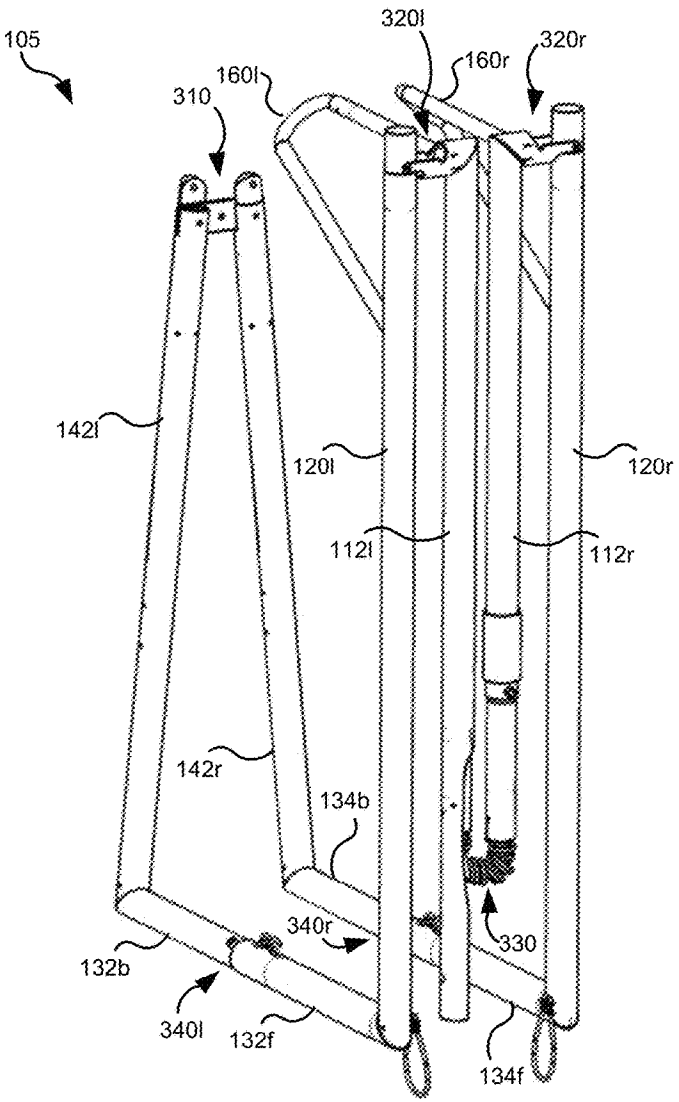

FIGS. 3A and 3B, collectively referred to herein as FIG. 3, are illustrations of support frame 105 in a semi-collapsed state, i.e., one in which the aforementioned mechanisms are brought to bear to fold support frame 105. As illustrated in the figure, lower crossbar 140 may comprise lower crossbar members 142*l* and 142*r* that may be joined one to the other by a lower crossbar joint 310. Upper crossbar 110 may comprise upper crossbar members 112*l* and 112*r* that may be joined one to the other by an upper crossbar joint 330. Uprights 120*l* and 120*r* may be coupled to respective upper upright members 112*l* and 112*r* through corner joints 320*l* and 320*r*. Base members 130*l* and 130*r* may each comprise base member sections: base member 130*l* may comprise base member sections 132*b* and 132*f* and base member 130*r* may comprise base member sections 134*b* and 134*f*. Base member sections 132*b* and 132*f* may be mechanically coupled at base member joint 340*l* and base member sections 134*b* and 134*f* may be mechanically coupled at base member joint 340*r*. Base member joints 340*l* and 340*r* may be collapsible, whereby base member section 132*b* is slidably received in base member section 132*f* and base member section 134*b* is slidably received in base member section 134*f*. Moreover, base member section 132*b* may be free to rotate within and relative to base member section 132*f*. Likewise, base member section 134*b* may be free to rotate within and relative to base member section 134*f*. It is to be observed that, in the illustrated embodiment, uprights 120*l* and 120*r* may be of continuous, unitary construction, e.g., a jointless component, to which other components may be attached.

Figure 5:
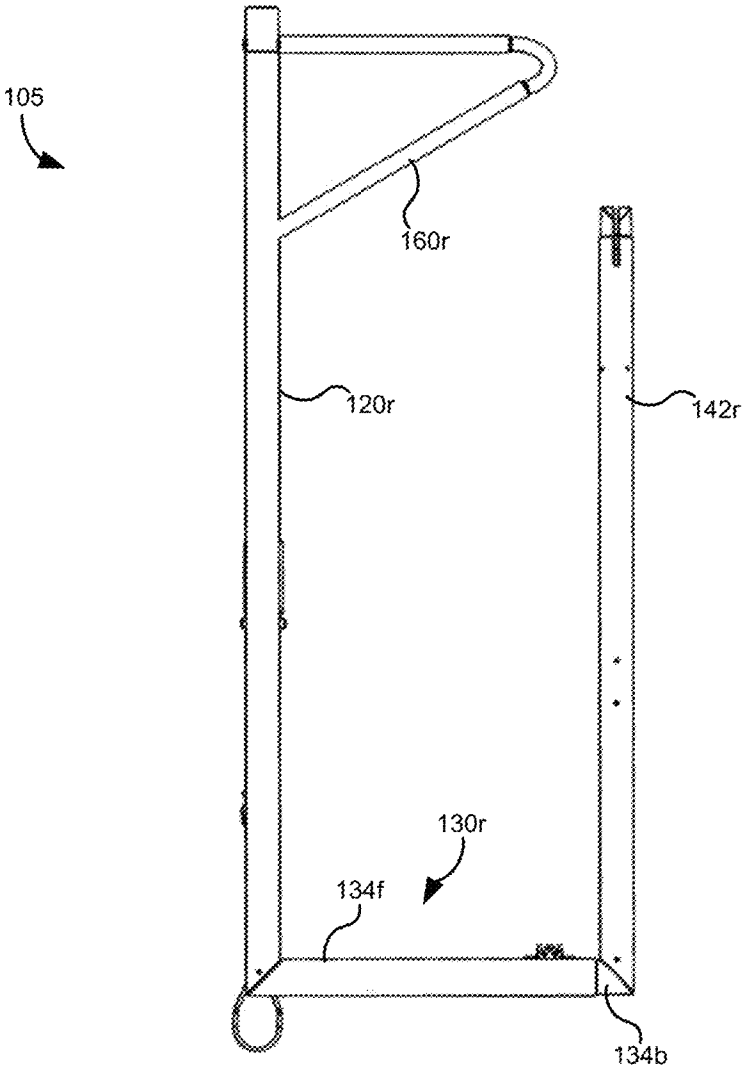
FIG. 5 is a right-side view of the support frame illustrated in FIG. 3B in its fully-collapsed storage ready state.

As is illustrated in FIG. 3, support frame 105 is folded from its fully-opened state illustrated in FIG. 1 into its fully-collapsed state (illustrated in FIG. 5). Folding game goal 100 (and the unfolding thereof) may be achieved by compelling various of its components along respective trajectories through space. More specifically, the folding activities yet to be described can be viewed as a set of trajectories traversed by one or more components of game goal 100 in response to corresponding applied forces. As used herein, a "trajectory" is a path through space taken by a component of game goal 100 or a portion of such component. It is to be understood that the present invention is not limited by specific user manipulation of components of game goal 100 to achieve a given configuration; various members and joints of game goal 100 interoperate such that force or manipulation applied to one component compels activity in at least one other component.

From its fully-opened play-ready state, game goal 100 may be folded by initially disengaging certain locking mechanisms (described below) and then by motivating lower crossbar joint 310 away from ground plane 103 and motivating upper crossbar joint 330 towards ground plane 103. In response to these forces, uprights 120*l* and 120*r* may be compelled along respective trajectories one towards the other. Conversely, applying force on uprights 120*l* and 120*r* such that one upright is driven towards the other compels lower crossbar joint 310 upwards (away from ground plane 103) and compels upper crossbar joint 330 downwards (toward ground plane 103). This duality will be recognized by skilled artisans and is to be understood as existing regardless of explicit disclosure of such.

As uprights 120*l* and 120*r* continue their respective trajectories one towards the other, upper crossbar members 112*l* and 112*r* and lower crossbar members 142*l* and 142*r* may become increasingly parallel to one another and to uprights 120*l* and 120*r*. An example of support frame 105 in an advanced state of folding is illustrated in FIG. 3B. Eventually, as uprights 120*l* and 120*r* reach the end of their respective trajectories, upper crossbar members 112*l* and 112*r*, and lower crossbar members 142*l* and 142*r* may become substantially parallel to uprights 120*l* and 120*r*. This state of mutual parallelism may occur coincidentally with the end of travel (trajectory terminus) in the folding direction of uprights 120*l* and 120*r*, upper crossbar members 112*l* and 112*r*, and lower crossbar members 142*l* and 142*r*. Base members 130*l* and 130*r* may remain parallel one to the other while support frame 105 is being folded.

Figure 4:
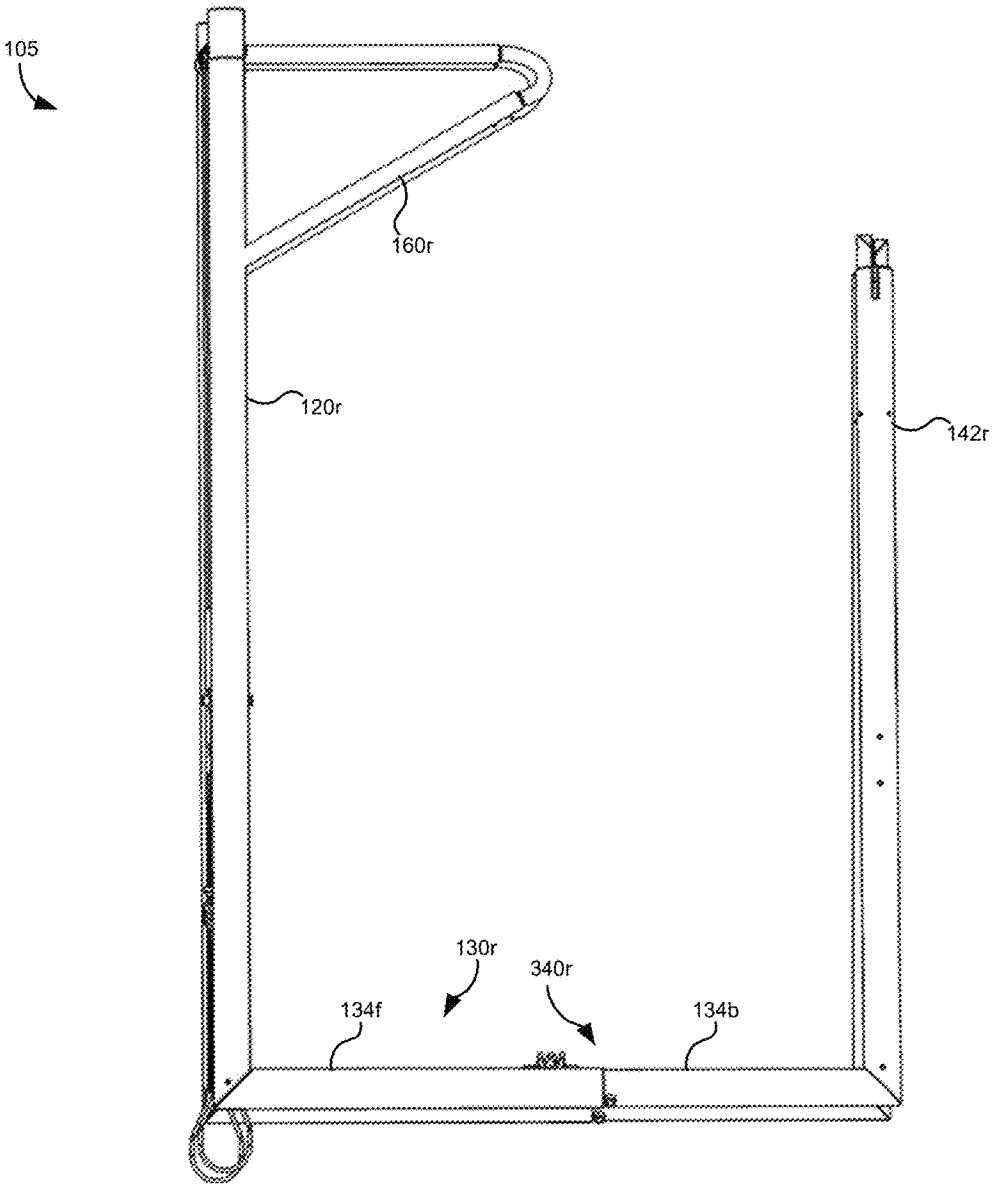
FIG. 4 is a right-side view of the support frame illustrated in FIG. 3B in which mutual parallelism of its members is depicted.

FIG. 4 is a right-side view of support frame 105 as folded per the description above to include the aforementioned mutual parallelism. As such, right-side components upright 120*r*, base member 130*r* and left lower crossbar section 142*r* are depicted, with their respective left-side counterparts and upper crossbar members 120*l* and 120*r* mostly hidden in this perspective view. It is to be observed in the figure that right base member 130*r* (and left base member 1301) is fully extended. Folding game goal 100 continues by retracting base member section 132*b* into base member section 132*f* and base member section 134*b* into base member section 134*f*, thereby decreasing the length of both base members 130*l* and 130*r*.

FIG. 5 is a right-side view of support frame 105 in its fully-collapsed transport/storage ready state. As will be described below, additional mechanisms and operations may be implemented to facilitate easier transportation and storage.

Having now described various general features that can be realized in embodiments of the present inventive concept, attention will now be drawn towards describing finer details of exemplary embodiments.

Figure 6:
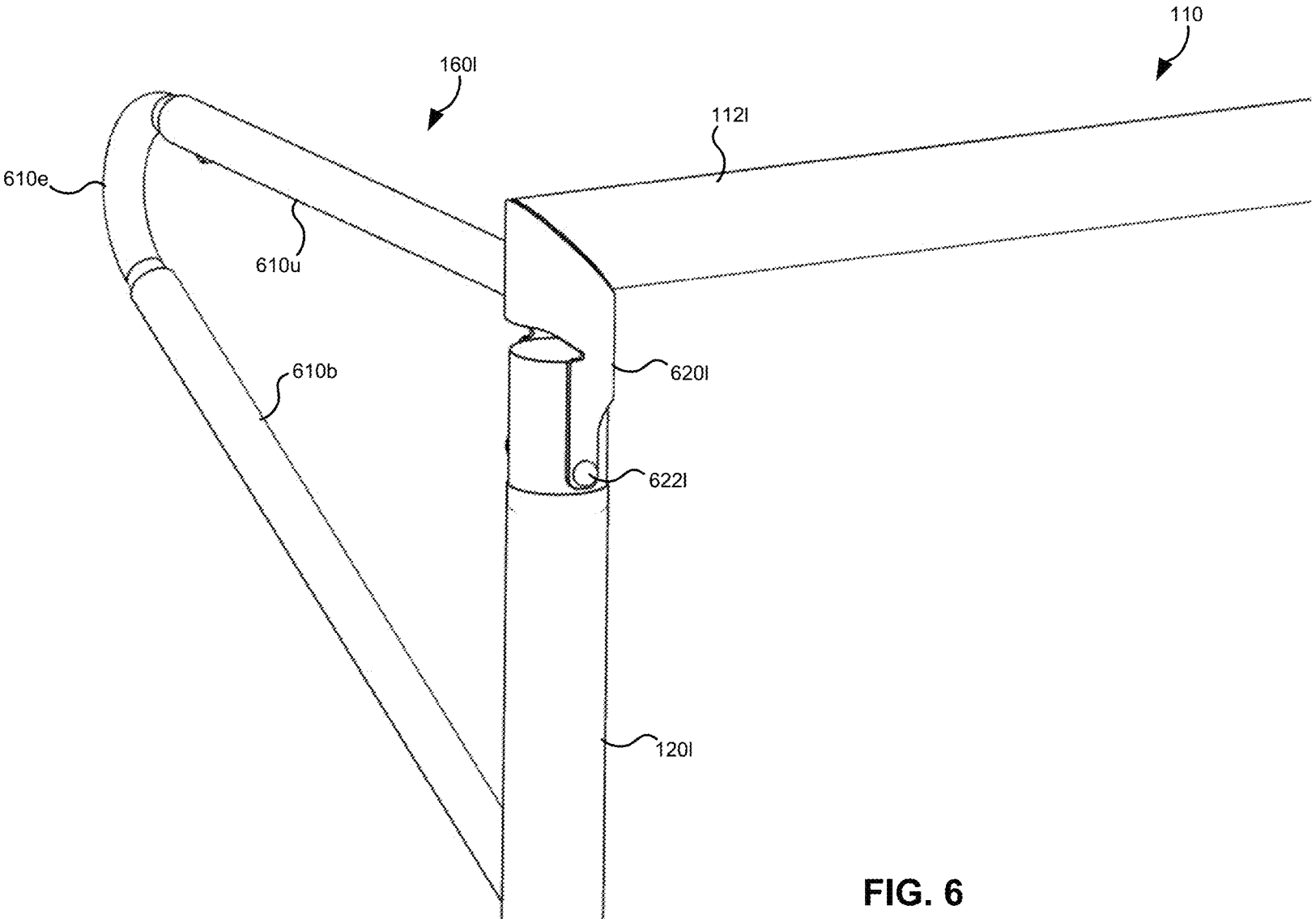
FIG. 6 is an illustration of an upper left portion of the support frame illustrated in FIG. 2 depicting the left corner at which an upper crossbar meets a left upright.

FIG. 6 is an illustration of an upper left portion of support frame 105 depicting the left corner at which upper crossbar 110 meets left upright member 120*l*. It is to be understood that the complementary right corner mechanisms operate in similar manner as the left corner mechanisms being now explained. As illustrated in the figure, the left corner portion of support frame 105 may comprise a left corner bracket 620*l* and a left backstay 160*l*, by which upper crossbar member 112*l* is allowed or otherwise afforded the agency to traverse a constrained, generally arcuate trajectory towards left upright 120*l*. The constraints on the trajectory may be achieved through a pivot point or a swivel, illustrated at pivot pin 622*l*, at the illustrated left upper corner of support frame 105. However, it is to be understood that the trajectory of any one of the components of support frame 105 may be constrained by and may be cooperative with other mechanisms thereof by which support frame 105 is folded (or unfolded). Such constraint and cooperation are easily gleaned by those skilled in the mechanical arts from the foregoing descriptions and depictions of the disclosed embodiments.

As illustrated in FIG. 6, left backstay 160*l* may comprise three (3) components: an upper backstay member 610*u*, a lower backstay member 610*b* and a backstay joint 610*e* mechanically interposed between upper backstay member 610*u* and lower backstay member 610*b*. In certain embodiments of the present invention, upper backstay member 610*u* is rigidly affixed to left corner bracket 620*l* and lower backstay member 610*b* is rigidly affixed to left upright 120*l*. As used herein, the term rigidly affixed is intended to connote a permanent or immutable mechanical connection between the subject components. Additionally, left corner bracket 620*l* may be rigidly affixed to upper crossbar member 112*l*. The present invention is not limited to specific techniques by which the subject components are rigidly affixed; example techniques include welding, swaging and gluing, but other connecting techniques known to skilled artisans can be borne to rigidly affix such components without departing from the spirit and intended scope of the present inventive concept.

Figure 7:
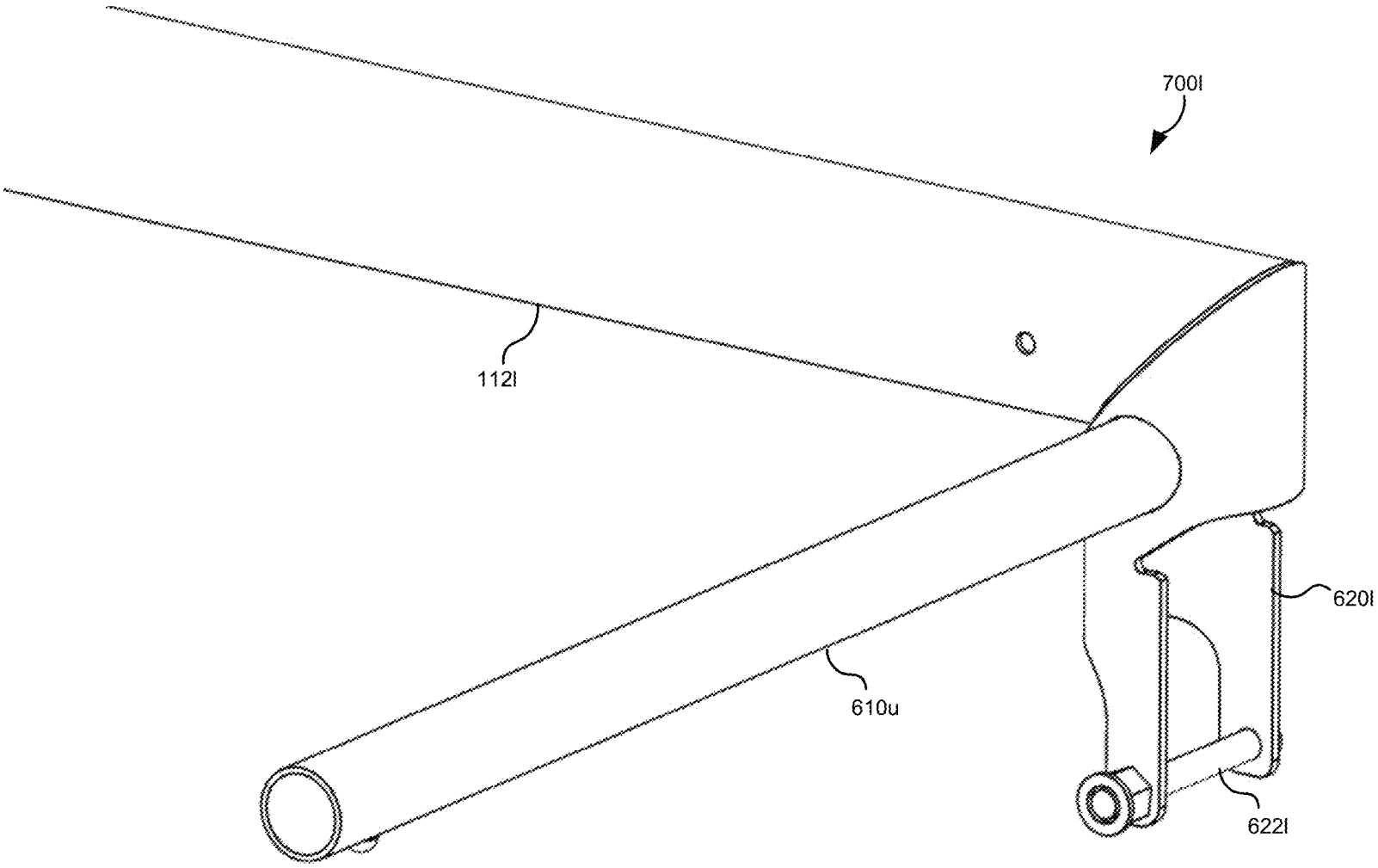
FIG. 7 is a rear-view illustration of a left corner assembly comprising an upper crossbar member, an upper backstay member and left corner bracket as might be embodied by the present inventive concept.

FIG. 7 is an illustration of a left corner assembly 700*l* comprising upper crossbar member 112*l*,upper backstay member 610*u* and left corner bracket 620*l*. Corner assembly 7001 is the resultant structure from certain of the foregoing connections, namely of left corner bracket 620*l* being rigidly affixed to both upper crossbar member 112*l* and to upper backstay member 610*u*. As such, left corner assembly 700*l* may be of singular construction that traverses space as a unit. When corner assembly 700*l* (and its complementary right corner assembly) is installed in an embodiment of the present invention, such motion through space is constrained along a substantially arcuate trajectory by pivoting about pivot pin 622*l*.

Figure 8:
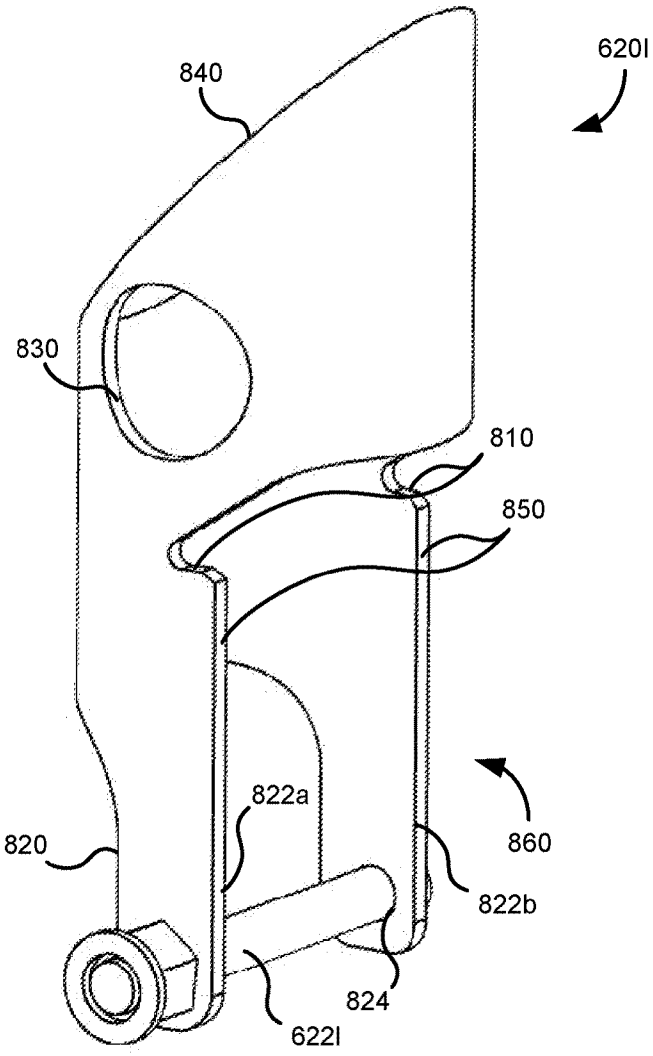
FIG. 8 is a rear-view illustration of the left corner bracket illustrated in FIG. 7 by which various features thereof may be described.

FIG. 8 is an illustration of left corner bracket 620*l* by which various features thereof may be described. As discussed above, left corner bracket 620*l* may be rigidly affixed to both upper backstay member 610*u* and upper crossbar member 112*l*. To that end, left corner bracket 620*l* may include a mitered surface 840 and a circular surface 830 at which upper crossbar member 112*l* and upper backstay member 610*u* are rigidly affixed.

As illustrated in FIG. 8, left corner bracket 620*l* may include a cutout 820 that provides clearance for left upright member 120*l* to be positioned in mutual parallelism with right upright member 120*r* when left corner assembly 700*l* is folded. Cutout 820 defines two (2) bracket legs 822*a* and 822*b* symmetrically disposed about left corner bracket 600*l*. A through-hole 824 may be formed near each distal end of bracket legs 822*a* and 822*b* through which pivot pin 622*l* is inserted. Additionally, left corner bracket 620*l* may include a pair of clamping tabs 850 that define a cup 860 by which left upright member 120*l* is mechanically captured when support frame 105 is fully opened. The elasticity of clamping tabs 850, which defines the clamping effectiveness of cup 860, may be established by the placement and depth of cutouts 810.

Figure 9A:
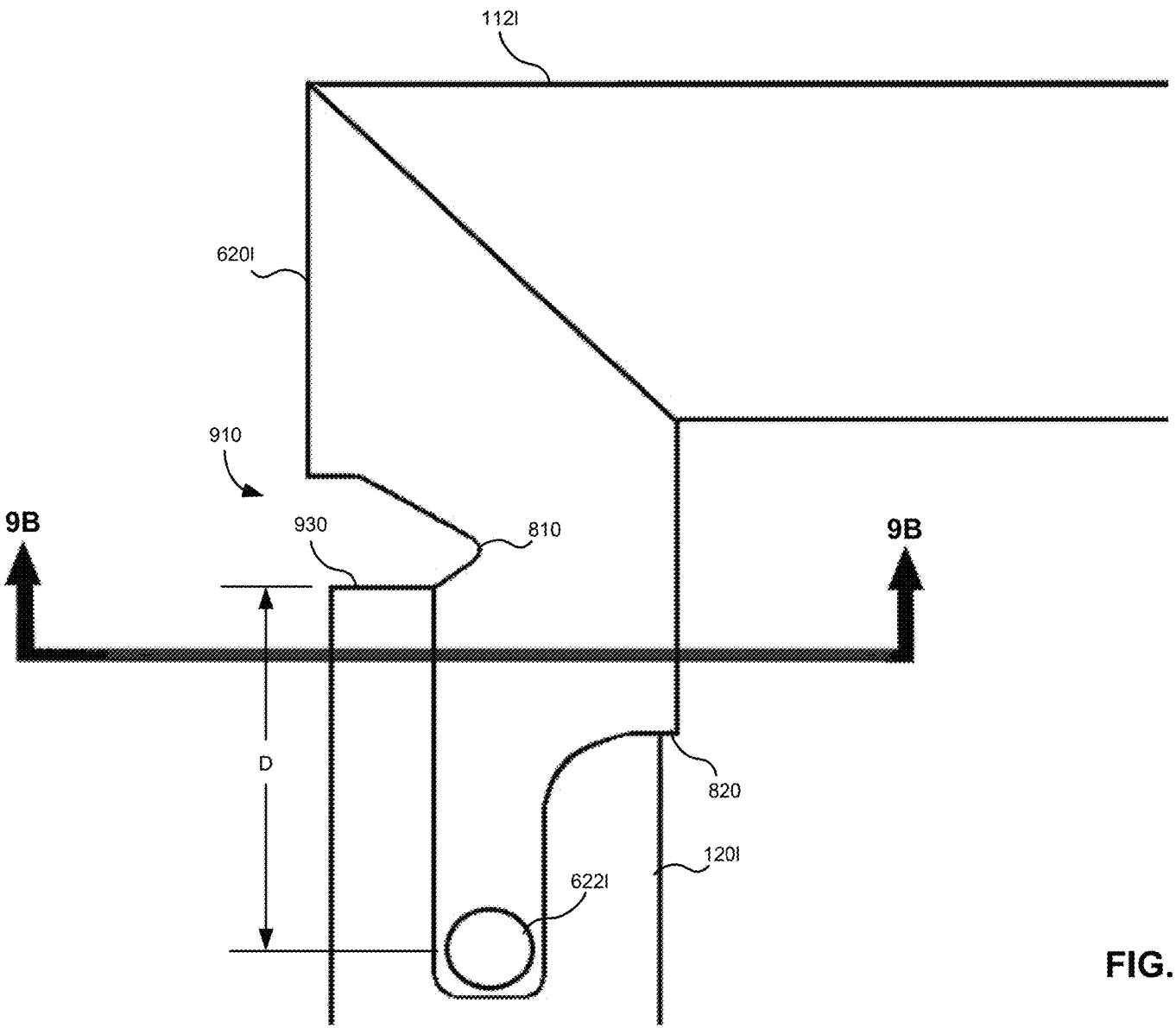
FIGS. 9A and 9B, collectively referred to herein as FIG. 9, are illustrations of the left corner bracket illustrated in FIG. 8 as installed on a support frame that might be embodied by the present inventive concept.
Figure 9B:
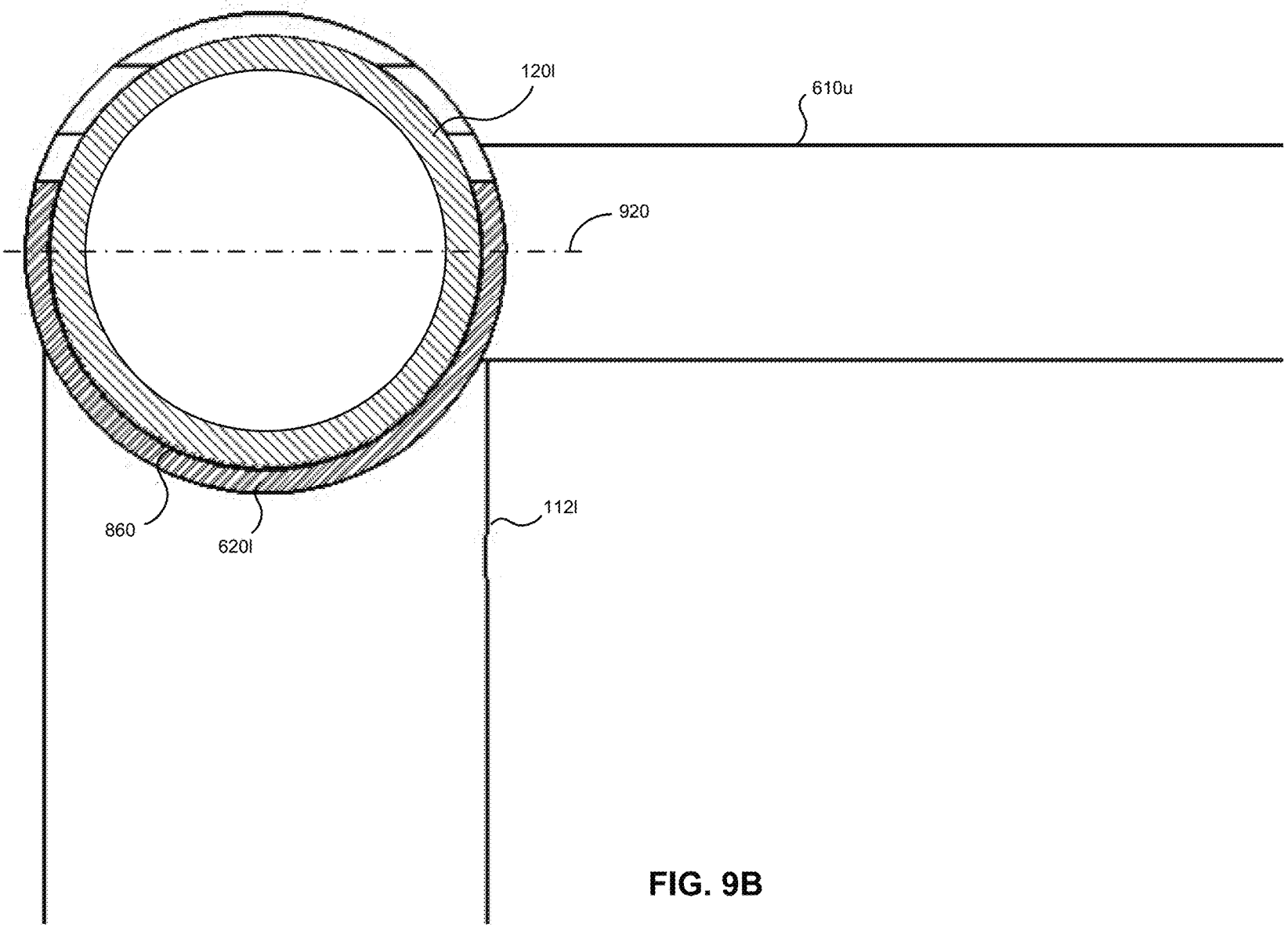

FIGS. 9A and 9B, collectively referred to herein as FIG. 9, are illustrations of left corner bracket 620*l* as installed on support frame 105. First, with reference to FIG. 9A, it is to be observed that pivot pin 622*l*, which extends through left upright member 120*l* and through both bracket legs 822*a* and 822*b*, is installed a distance D from an end 930 of left upright 120*l* that faces upper crossbar member 112*l*. This distance D assures that opening 910 is properly positioned so that left corner bracket 620*l* clears upright end 930 as left corner assembly 700*l* (illustrated in FIG. 7) is compelled by applied force to pivot or otherwise rotate about pivot pin 622*l*.

FIG. 9B is a cross-sectional view of the mechanical arrangement depicted in FIG. 9A taken at the sectional view line indicated in the figure. A center line 920 is illustrated in FIG. 9B to mark the center of left upright 1201. With reference to center line 920, it is to be observed that cup 860 of left corner bracket 620*l* circumferentially extends beyond center line 920. Put another way, cup 860 may have an arcuate cross-section defining an arc that is enclosed by an angle greater than 71 The portion of the arc exceeding that enclosed by angle of $\pi$ can be varied by application, but should be sufficient to capture left upright 120*l* in a snap fit. Here, the term "snap fit" refers to a mechanical engagement of components in which continued application of opposing forces applied across the components gradually increases the size of an elastically biased insertion area of one of the components until that insertion area is of such size as to allow another one of the components to pass through the insertion area, at which time the insertion area at least partially collapses around the component and captures the component in the other component.

Figure 10A:
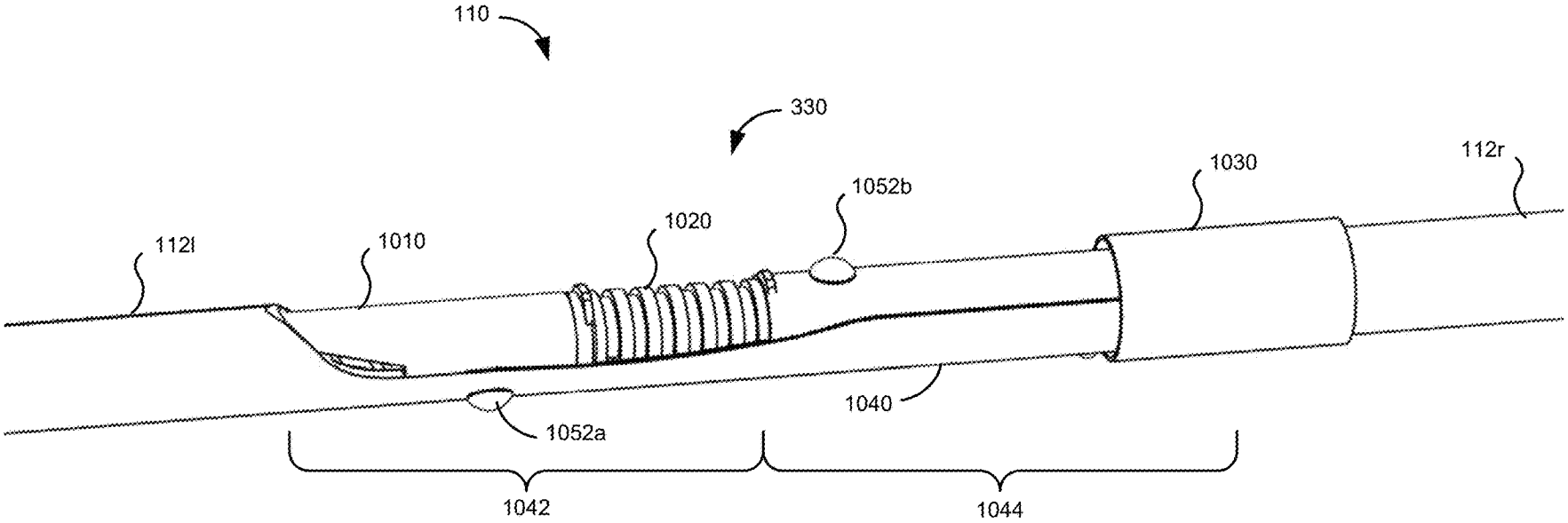
FIGS. 10A and 10B, collectively referred to herein as FIG. 10, are illustrations of an upper crossbar that may be embodied by the present inventive concept in which an upper crossbar joint is emphasized for purposes of explaining various features thereof.
Figure 10B:
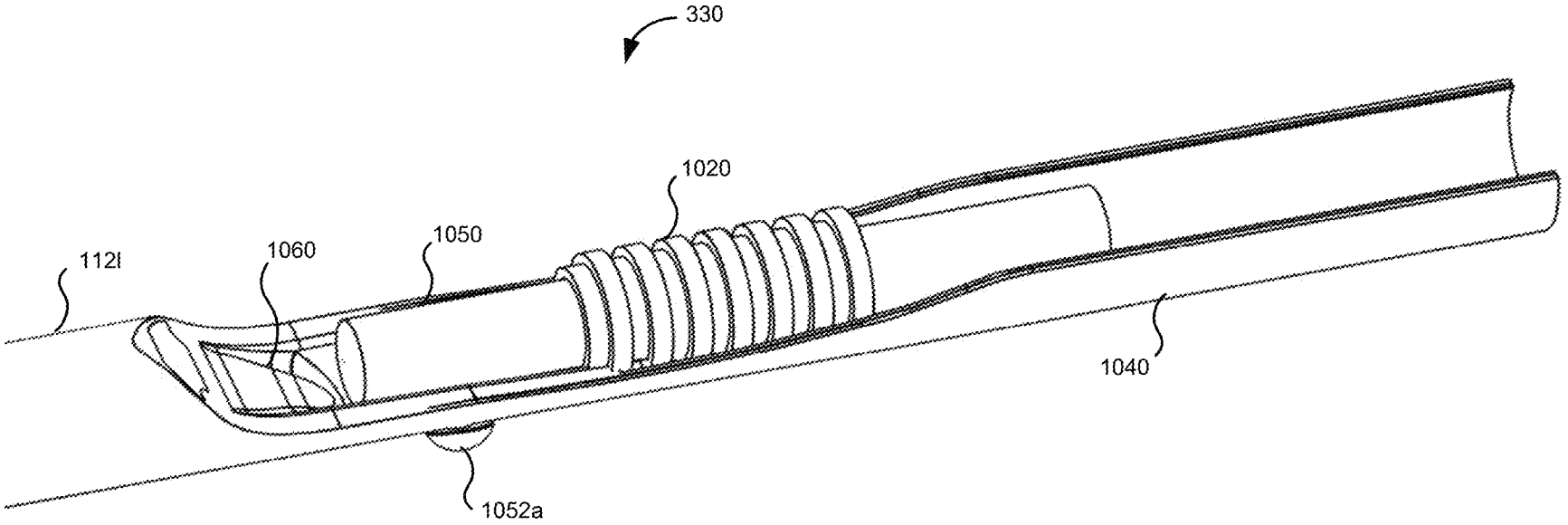

FIGS. 10A and 10B, collectively referred to herein as FIG. 10, are illustrations of upper crossbar 110 in which upper crossbar joint 330 is emphasized for purposes of explaining various features thereof. As described above, upper crossbar joint 330 may be mechanically interposed between upper crossbar members 112*l* and 112*r*. To accommodate components of upper crossbar joint 330, embodiments of the present inventive concept may include a cradle-shaped structure, referred to herein as a spoon 1040, formed on an end of either one of left upright member 112*l* or right upright member 112*r*. That is, although FIG. 10 illustrates spoon 1040 being formed on left upright member 112*l*,it can just as effectively be formed on right upright member 112*r*.

Referring momentarily to FIG. 10B, it is to be observed that an elastomeric rod 1050 may reside at the core of upper crossbar joint 330. It is to be understood that although elastomeric rod 1050 is illustrated in the figure as being circular in cross-section, the present invention is not so limited. Indeed, skilled artisans may identify and utilize rods of many different cross-sectional shapes and remain within the scope and intended scope of the present invention.

In certain embodiments, elastomeric rod 1050 is constructed from a polymer, such as polyurethane, and has an innate resting state e.g., straight or unbent, to which it naturally returns after being released from a bent state. Elastomeric rod 1050 may be affixed at opposing ends thereof using any fastening mechanism suitable and sufficient to retain elastomeric rod 1050 in upper crossbar joint 330 as forces are applied to bend upper crossbar 110 and, therewith, elastomeric rod 1050. In FIG. 10, the fastening mechanism is illustrated as screws or rivets 1052*a*, which may affix elastomeric rod 1050 to left upper crossbar member 112*l*, and 1052*b*, which may affix elastomeric rod 1050 to right upper crossbar member 112*r*.

Returning to FIG. 10A, remaining features of upper crossbar joint 330 will now be described. Prior to explaining functionality assigned to each component, it is to be observed that in its unbent state illustrated in the figure, upper crossbar joint 330 presents a generally even structure that conceals elastomeric rod 1050. Such structure may comprise an inflexible covering 1010 and a flexible covering 1020. In certain embodiments, flexible covering 1020 may be installed onto elastomeric rod 1050 as a stack of circular rings through which elastomeric rod 1050 is inserted. Inflexible covering 1010 may be installed adjacent to flexible covering 1020 and may be constructed or otherwise configured to conceal an end of elastomeric rod 1050 as well as space 1060 (FIG. 10B). Inflexible covering 1010 and flexible covering 1020 define a substantially uniform outer diameter across upper crossbar joint 330 so as to appear as a solid component while, at the same time, allowing upper crossbar joint 330 to bend.

Figure 11:
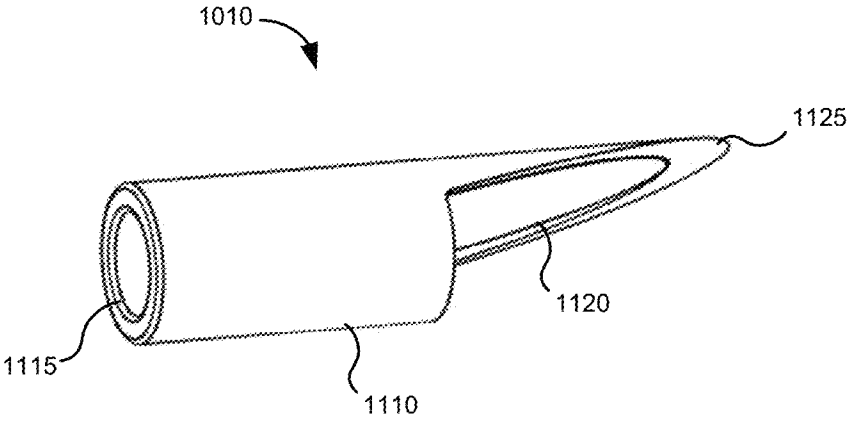
FIG. 11 is an illustration of an inflexible covering of an upper crossbar joint that may be embodied by the present inventive concept.

FIG. 11 is an illustration of inflexible covering 1010 of upper crossbar joint 330. Inflexible covering 1010 may comprise a barrel 1110 having a through-hole 1115 formed therein that accommodates an end of elastomeric rod 1050. That is, through-hole 1115 may be sized to have a slightly larger diameter than elastomeric rod 1050 such that elastomeric rod 1050 can be inserted into barrel 1110. Further, inflexible covering 1010 may include a bayonet 1120 that extends from barrel 1110 and terminates at a bayonet point 1125. Inflexible covering 1010 may be installed by inserting elastomeric rod 1050 through barrel 1110 and inserting bayonet tip 1125 into an open end of upper crossbar member 112*r*, as illustrated in FIG. 10A.

Figure 12:
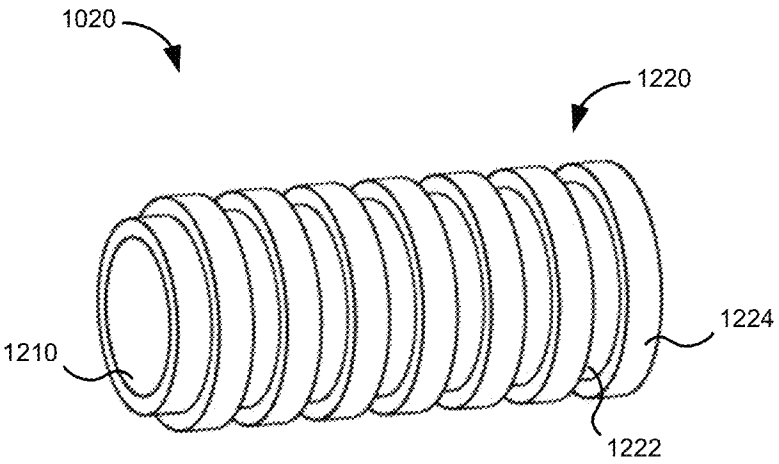
FIG. 12 is an illustration of a flexible covering of the upper crossbar joint illustrated in FIG. 10.

FIG. 12 is an illustration of flexible covering 1020 of upper crossbar joint 330. As discussed above, flexible covering 1020 may comprise a set of circular rings 1220, each having a raised portion 1224 and a recessed portion 1222. Circular rings 1220 may be stacked to form a tube 1210 through which elastomeric rod 1050 is inserted.

Returning to FIG. 10, inflexible covering 1010 and flexible covering 1020 may be installed over elastomeric rod 1050 and the entire assembly of these components may be installed in spoon 1040. Further, the entire assembly of inflexible covering 1010, flexible covering 1020 and elastomeric rod 1050 may be retained in spoon 1040 by way of fasteners 1052*a* and 1052*b*. It is to be observed that spoon 1040 may be wider at an end 1044 thereof than that that extends over right upper crossbar member 112*r*, illustrated in FIG. 10 at end 1042, which is formed in the bendable region 1042 of upper crossbar joint 330. Indeed, in certain embodiments, end 1044 may be constructed or otherwise configured to capture right upper crossbar member 112*r* in a snap fit, similar to that described above with regard to FIG. 9.

As illustrated in FIG. 10, spoon 1040 extends from left upper crossbar member 112*l*, through the covered upper crossbar joint 330 to right upper crossbar member 112*r*. To retain spoon 1040 in engagement with right upper crossbar member 112*r*, certain embodiments of the present invention may include a retention collar 1030. That is, retention collar 1030 may be positioned towards upper crossbar joint 330 to lock upper crossbar 110 in position for game play and may be moved away from upper crossbar joint 330 to fold support frame 105 into its storage/transport state. In certain embodiments, a detent (not illustrated) or similar mechanism may be employed to hold retention collar 1030 in a position away from upper crossbar joint 330 as support frame 105 is folded.

Figure 13A:
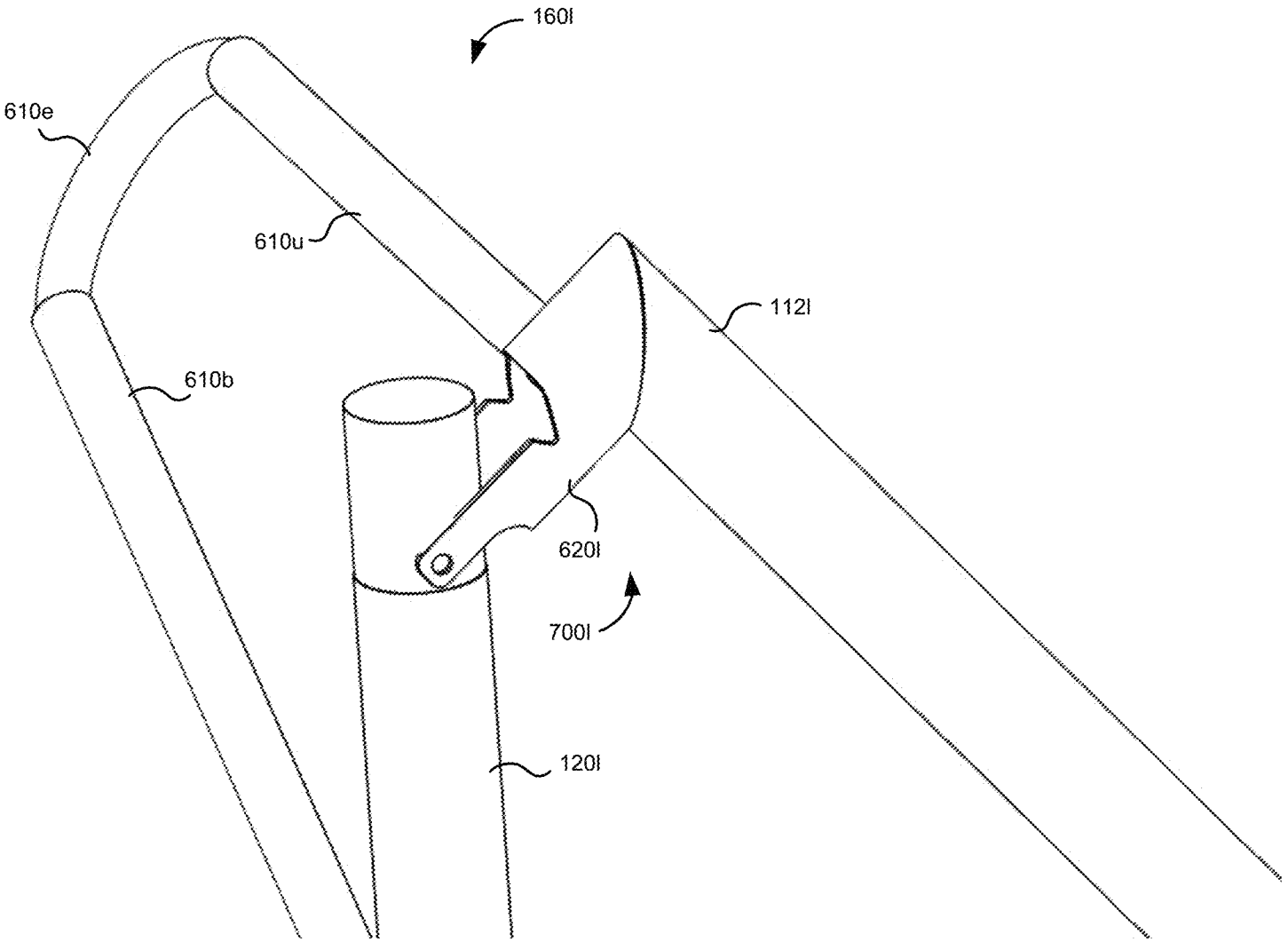
FIGS. 13A and 13B, collectively referred to herein as FIG. 13, is an illustration of a left backstay that might be embodied by the present inventive concept as it contorts in response to a left corner assembly illustrated in FIG. 7 following its trajectory in the folding direction.
Figure 13B:
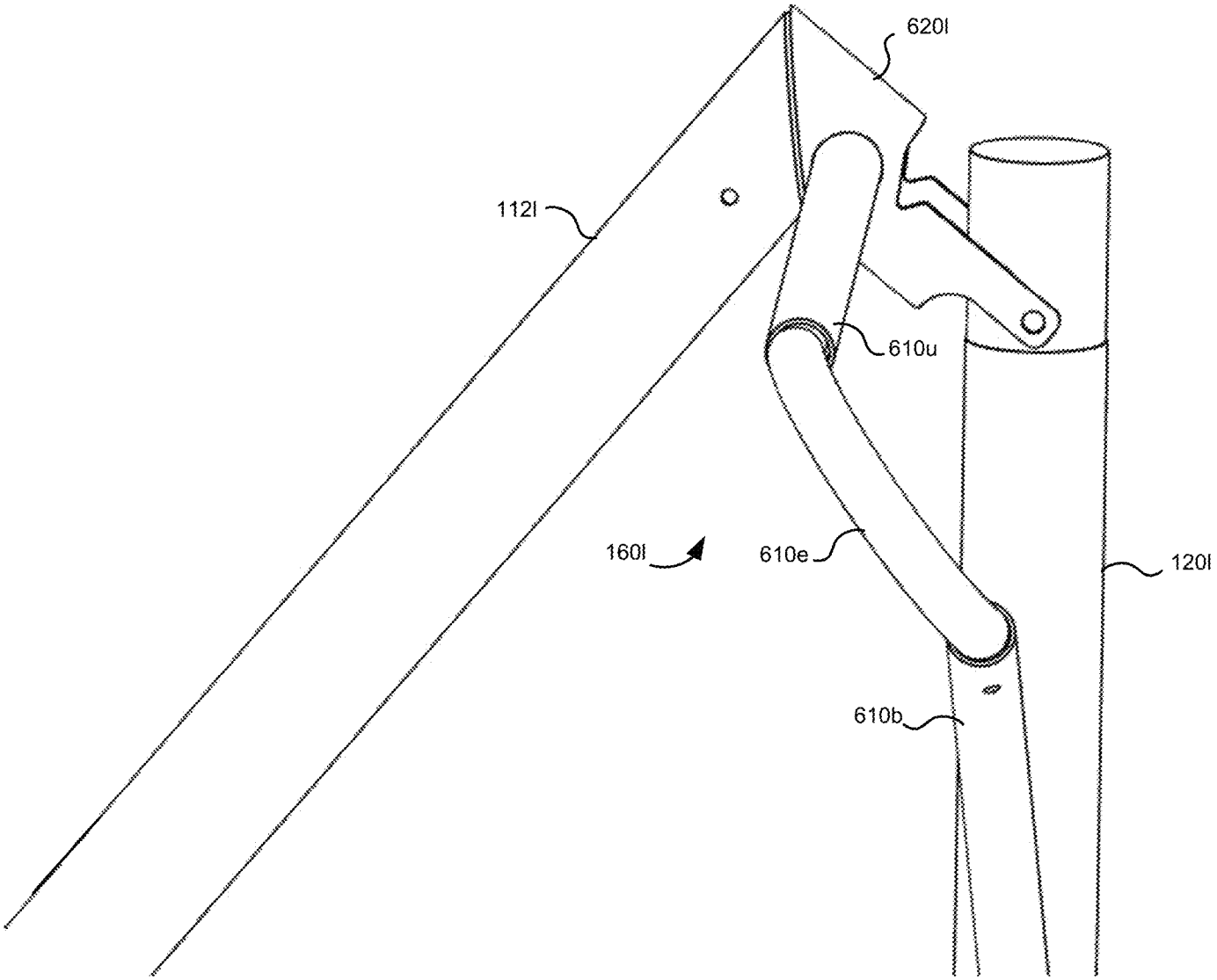

FIGS. 13A and 13B, collectively referred to herein as FIG. 13, is an illustration of left backstay 160*l* as it contorts in response to left corner assembly 700*l* following its trajectory in the folding direction. As indicated above, left upper backstay member 610*u* is a component of left corner assembly 700*l* and, as such, is rigidly affixed to left corner bracket 620*l*, which itself is rigidly affixed to left upper crossbar member 112*l*. Consequently, as upper crossbar joint 330 is compelled towards ground plane 103, upper backstay member 610*u* follows left corner bracket 620*l* along its trajectory. Recalling that lower backstay member 610*b* is rigidly affixed to left upright 120*l* and therefore remains stationary relative to upper backstay member 610*u*, backstay joint 610*e*, which is mechanically interposed between relatively moving upper backstay member 610*u* and relatively stationary lower backstay member 610*b*, may be constructed or otherwise configured to contort. FIG. 13A is a rear view of an exemplary backstay 160*l* exhibiting the contortion of backstay joint 610*e* and FIG. 13B is a front view of backstay 160*l* depicted in FIG. 13A. In certain embodiments, backstay joint 610*e* may be manufactured from material similar to that used in upper crossbar joint 330, e.g., polyurethane.

Figure 14A:
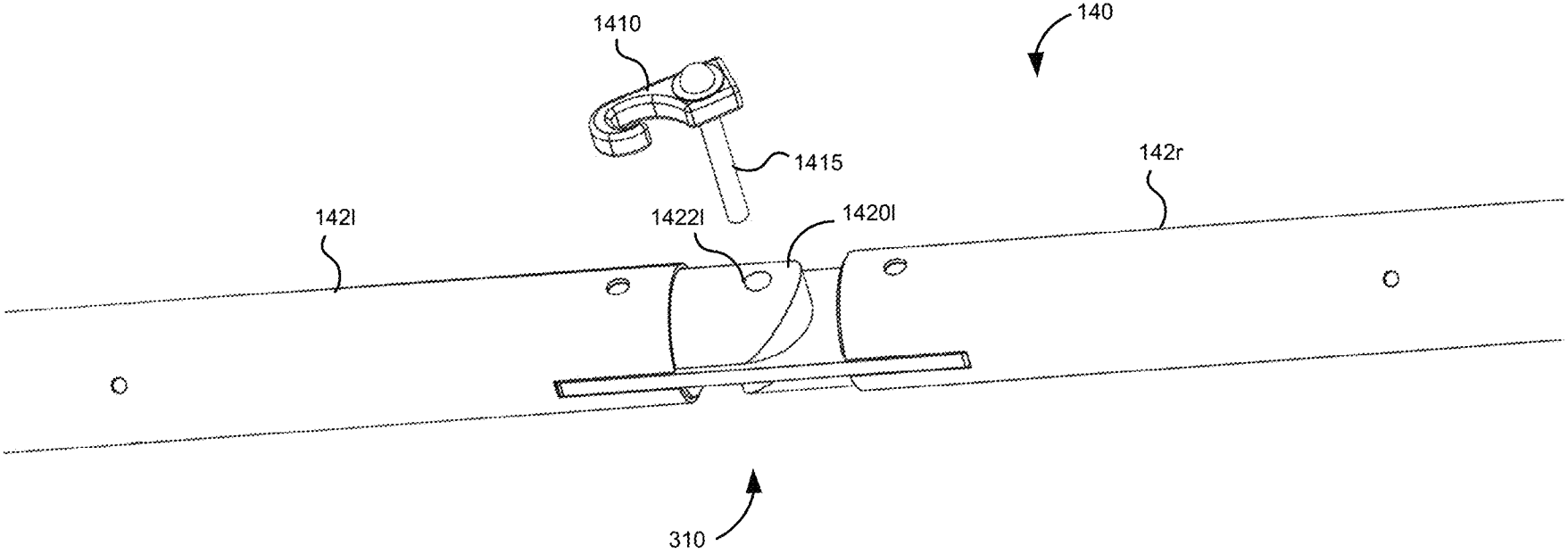
FIGS. 14A and 14B, collectively referred to herein as FIG. 14, is an illustration of a lower crossbar with a detailed view of a lower crossbar joint, both of which may be embodied by the present inventive concept.
Figure 14B:
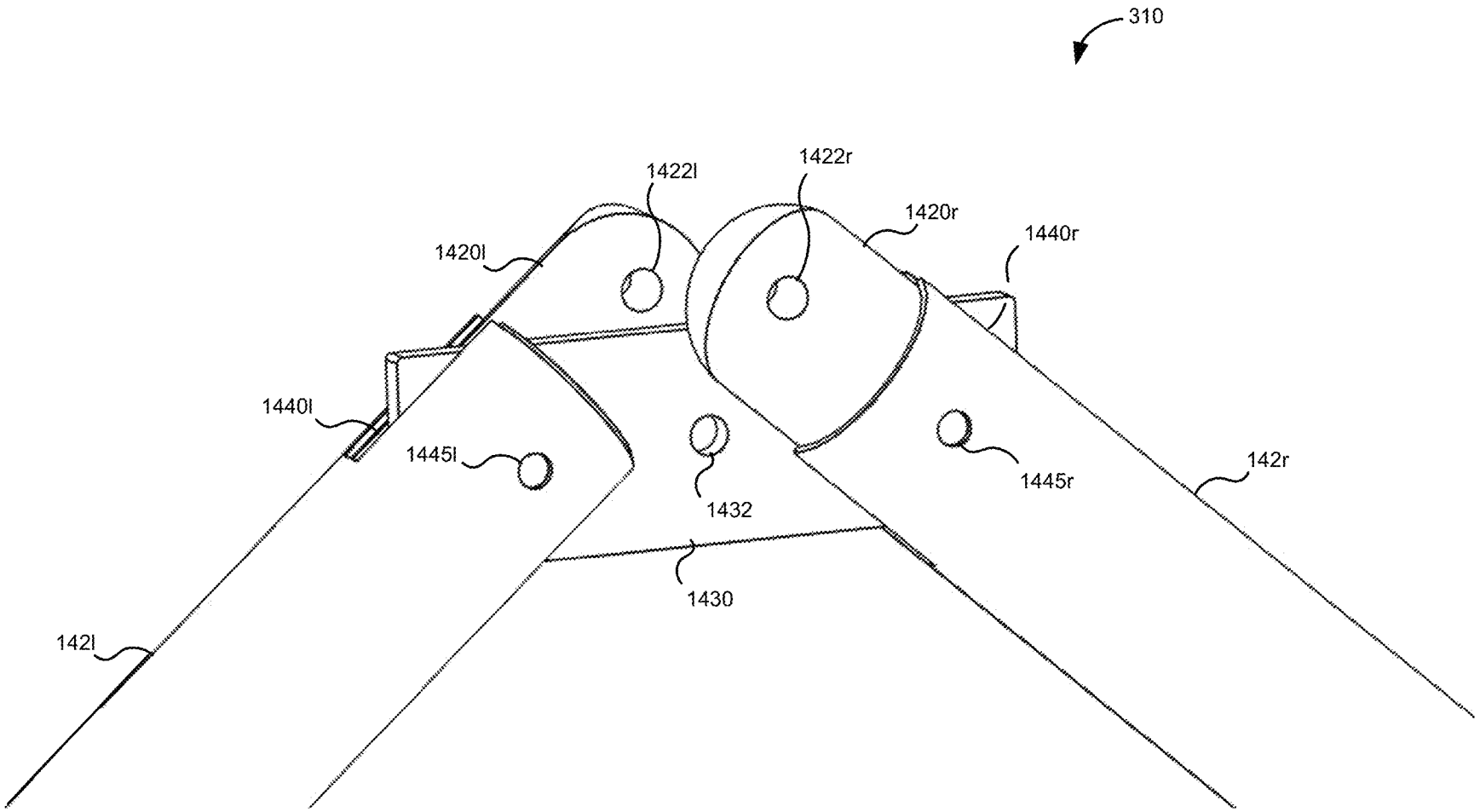

FIGS. 14A and 14B, collectively referred to herein as FIG. 14, is an illustration of lower crossbar 140 with a detailed view of lower crossbar joint 310. Lower crossbar 140 may be locked in the fully open game-ready state via a locking pin 1415 inserted into through-holes 1422*l* and 1422*r* formed in terminators 1420*l* and 1420*r*. Additionally, locking pin 1415 may also pass through through-hole 1432 formed in lower crossbar bracket 1430.

Referring to FIG. 14B, lower crossbar joint 310 is illustrated in an unlocked state to describe further details of lower crossbar joint 310. As illustrated in the figure, left and right lower crossbar members 142*l* and 142*r* may have slits 1440*l* and 1440*r*, respectively, formed therein to accommodate lower crossbar joint bracket 1430. That is, as lower crossbar joint 310 is compelled away from ground plane 103, left and right lower crossbar members 142*l* and 142*r* rotate on pivot pins 1445*l* and 1445*r*, respectively. Slots 1440*l* and 1440*r* afford such rotation without interference from lower crossbar joint bracket 1430. Lower crossbar joint bracket 1430 as well as the locations relative thereto of pivot pins 1445*l* and 1445*r* allow lower crossbar members 142*l* and 142*r* to come into mutual parallelism one with the other when support frame 105 is fully collapsed. Additionally, it is to be noted that through-holes 1422*l*,1422*r* and 1432 align when support frame 105 is fully unfolded, whereby locking pin 1415 can be inserted through all three through-holes simultaneously thus prohibiting further movement of lower crossbar members 142*l* and 142*r*.

As illustrated in FIG. 14, embodiments of the present invention may include a net hook 1410. When game goal 100 is in its fully collapsed state, net hook 1410 may be deployed to capture a portion of net 107 as a mechanism for retaining the components of game goal 100 against inadvertent opening thereof. For example, recalling from above that base member joints 340*l* and 340*r* allow relative rotation of base member sections 132*l*, 132*r*, 134*l* and 134*r*, net hook 1410, when net 107 is captured thereby, may prevent such relative rotation between base member sections 132*l*, 132*r*, 134*l* and 134*r*.

Figure 15:
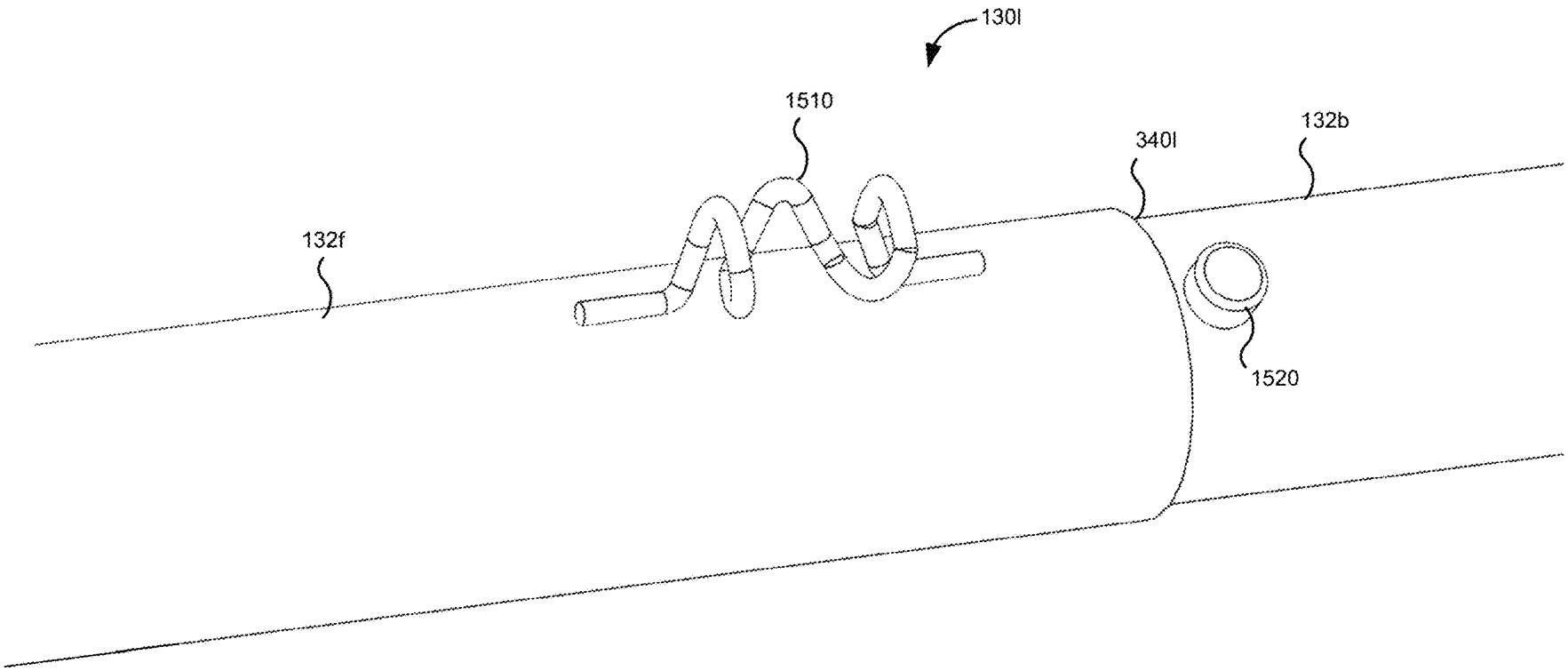
FIG. 15 is an illustration of a left base member depicting various features thereof that may be used in conjunction with embodiments of the present invention.

FIG. 15 is an illustration of left base member 130*l* depicting various features thereof that may be used in conjunction with embodiments of the present invention. Recalling that base member section 132*b* is retractable into base member section 132*f*, such as at base member joint 340*l*, it will be appreciated by skilled artisans that a fastener that pierces base member section 132*f* has the potential of preventing base member 132*b* from being freely inserted into base member section 132*f* Accordingly, embodiments of the present invention may utilize other mechanisms by which net 107 is secured to support frame 105 along the sides thereof. For example, as illustrated in FIG. 15, base member section 132*f* may have affixed thereon one or more net lock hooks 1510. The present invention is not limited to a particular technique by which net lock hook 1510 is affixed to base member section 132*f*, examples of which include welding and gluing.

Also illustrated in FIG. 15 is a detent 1520 by which base member section 132*b* is retained in an extended state relative to base member section 132*f* As depicted in the figure, detent 1520 may engage base member section 132*f* at base member joint 340*l* to prevent base member section 132*b* from entering base member section 132*f*. When it is desired to collapse base member 130*l*, pressure may be applied to detent 1520 such that detent 1520 passes into base member section 132*f*. Detent 1520 may be elastically biased in an outward direction to once again prevent base member section 132*b* from entering base member section 132*f*. It is to be understood that other techniques may be used to lock base member 130*l* in an extended state without departing from the spirit and intended scope of the present invention.

Figure 16:
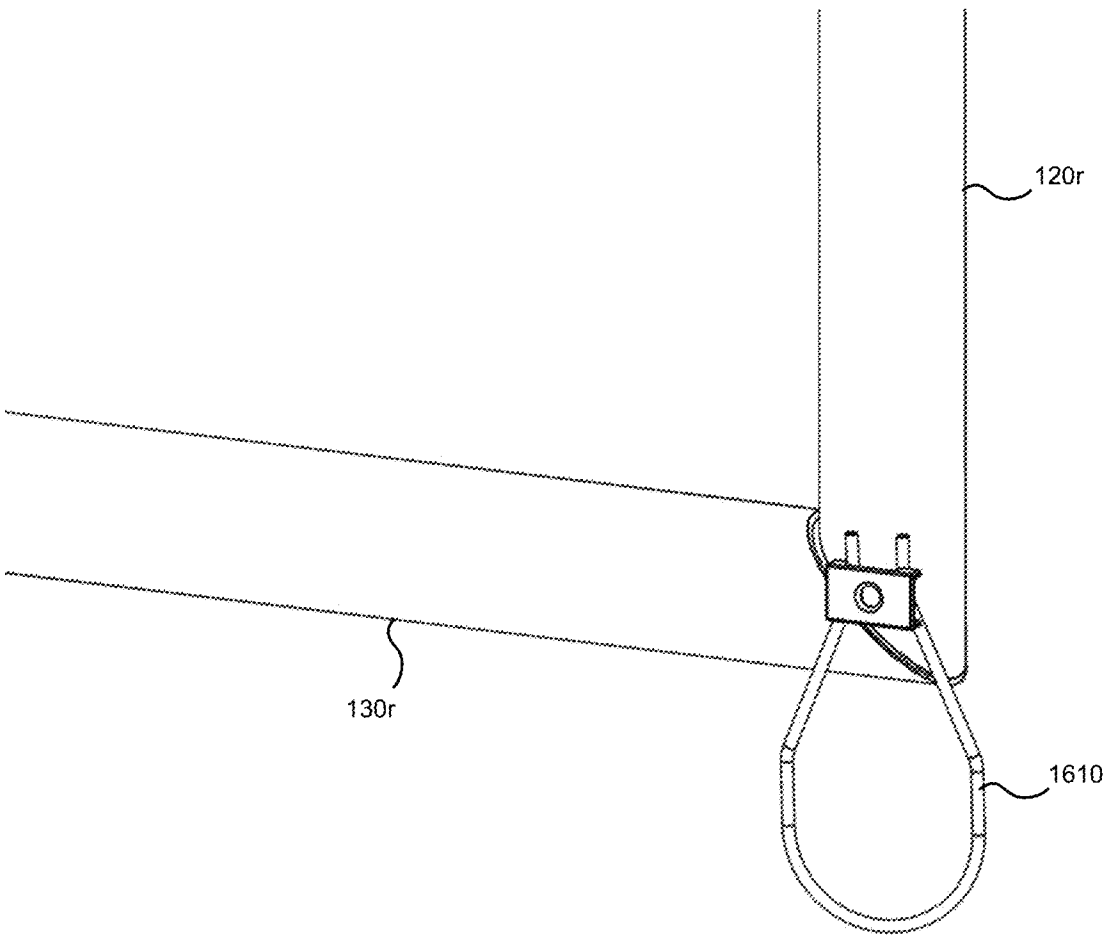
FIG. 16 is an illustration of a ground corner of a support frame that may be embodied by the present inventive concept.

FIG. 16 is an illustration of a ground corner of support frame 105, i.e., the corner of support frame 105 comprising upright 120*r* and base member 130*r*. As illustrated in the figure, a hold-down strap 1610 may be provided to prevent all of game goal 100 from rising in the air as game goal 100 is unfolded. The present invention can be embodied with many different implementations of hold-down strap 1610 without departing from the spirit and intended scope thereof.

The descriptions above are intended to illustrate possible implementations of the present inventive concept and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalents.

What is claimed is:

1. A game goal comprising:

a net; and a support frame by which the net is supported, the support frame being articulated to collapse into a storage-ready state and expand into a play-ready state, the support frame comprising:

a crossbar and a pair of uprights supporting the crossbar in the play-ready state;

corner brackets rigidly attached to the crossbar and pivotally coupled to the respective uprights;

backstays by which a hood is formed in the net, the backstays comprising:

upper backstay members rigidly attached to the respective corner brackets;

lower backstay members rigidly attached to the respective uprights; and elastomeric backstay joints mechanically interposed between the respective upper and lower backstay members.

2. The game goal of claim 1, wherein the corner brackets each comprise tabs with which the corresponding uprights are captured in a snap fit.

3. The game goal of claim 1, wherein the crossbar comprises crossbar members, the corner brackets being rigidly affixed to respective ones of the crossbar members.

4. The game goal of claim 3, wherein the support frame includes a crossbar joint mechanically interposed between the crossbar members.

5. The game goal of claim 4, wherein the crossbar joint comprises an elastomeric core mechanically coupled at respective ends thereof to the respective crossbar members.

6. The game goal of claim 5, wherein the elastomeric core is disposed in a recessed portion of one of the crossbar members.

7. The game goal of claim 6, further comprising a joint cover encasing the elastomeric core within the recessed portion, the joint cover having an outer surface that extends across the recessed portion.

8. A support frame of a game goal over which a net is disposed, the support frame comprising:

rigid frame members including uprights and a crossbar by which a goal plane is defined;

wherein the rigid frame members are displaceable one relative to another to collapse the support frame into a storage-ready configuration and to expand the support frame into a play-ready configuration;

corner brackets rigidly attached to the crossbar and pivotally coupled the respective uprights; and backstay members by which a hood is formed in the net, the backstay members comprising:

upper backstay members rigidly attached to the respective corner brackets;

lower backstay members rigidly attached to the respective uprights; and elastomeric backstay joints mechanically interposed between the respective upper and lower backstay members.

9. The support frame of claim 8, wherein the crossbar comprises crossbar members, the corner brackets being rigidly affixed to respective ones of the crossbar members.

10. The support frame of claim 9, wherein a crossbar joint is interposed between the crossbar members.

11. The support frame of claim 10, wherein the crossbar joint comprises an elastomeric core mechanically coupled at respective ends thereof to respective crossbar members.

12. The support frame of claim 11, wherein the elastomeric core is disposed in a recessed portion of one of the crossbar members.

13. The support frame of claim 12, further comprising a joint cover encasing the elastomeric core within the recessed portion, the joint cover having an outer surface that extends across the recessed portion.

14. The game goal of claim 8, the corner brackets each comprise tabs with which the corresponding uprights are captured in a snap fit.

* * * * *